United States Patent [19]

Mardian et al.

[11] Patent Number: 4,998,598

[45] Date of Patent: Mar. 12, 1991

[54] ACOUSTICAL DOOR

[75] Inventors: James K. W. Mardian, Scottsdale, Ariz.; Curtis I. Holmer, Reston, Va.

[73] Assignee: The Ceco Corporation, Oakbrook Terrace, Ill.

[21] Appl. No.: 357,801

[22] Filed: May 30, 1989

[51] Int. Cl.[5] ..... E04B 1/82

[52] U.S. Cl. ..... 181/284; 181/287; 181/288; 181/290

[58] Field of Search ..... 181/210, 284, 290, 295, 181/291, 287, 288

[56] References Cited

U.S. PATENT DOCUMENTS

| | | | |
|---|---|---|---|
| 2,116,270 | 5/1938 | LeGrand | 52/347 |
| 3,319,738 | 5/1967 | Wehe, Jr. | 181/290 |
| 3,506,088 | 4/1970 | Sherman | 181/290 |
| 3,534,829 | 10/1970 | Schneider | 181/290 |
| 3,656,576 | 4/1972 | Gubela | 181/210 |
| 4,042,061 | 8/1977 | Murakami | 181/210 |
| 4,621,709 | 11/1986 | Naslund | 181/284 |

*Primary Examiner*—Benjamin R. Fuller

*Attorney, Agent, or Firm*—Cahill, Sutton & Thomas

[57] ABSTRACT

A light-weight acoustical door is comprised of a wood frame separating and joining first and second panels and providing a space between the panels which filled with fibrous sound-absorbing material. Each panel is comprised of at least three layers, two of which are significantly more dense than the other layer. One of the dense layers may be made from a a weighted plastic sheet. One of the panels may have grooves formed in the inner face thereof.

7 Claims, 1 Drawing Sheet

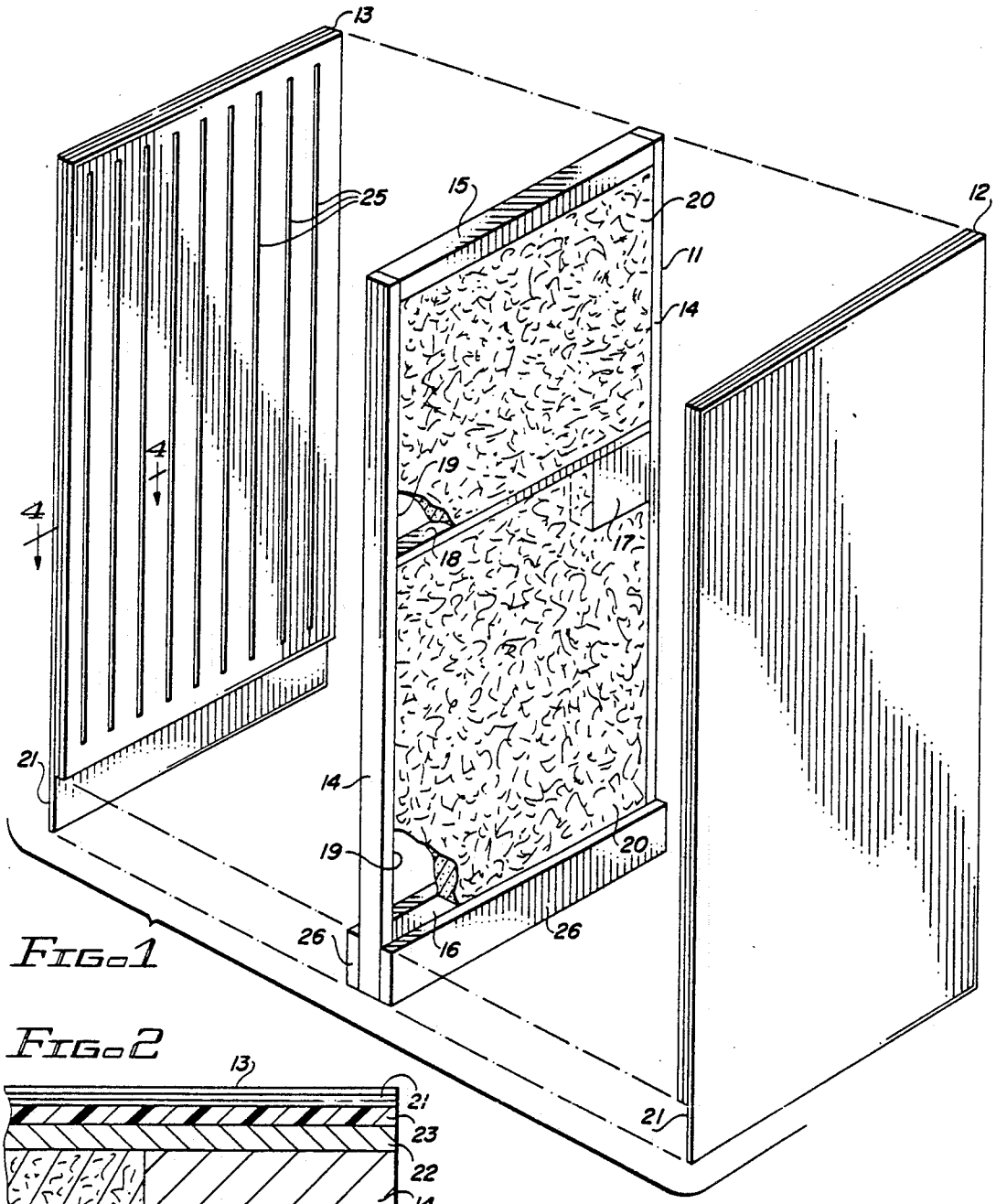
FIG. 1
FIG. 2
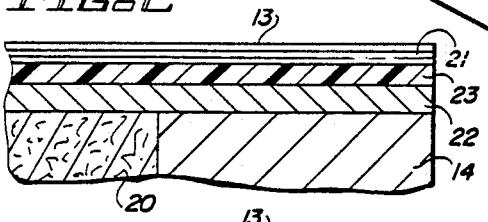
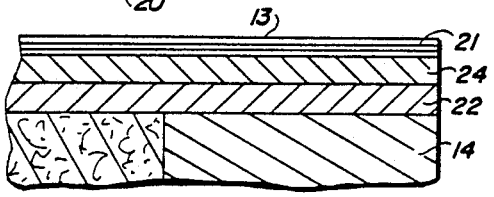
FIG. 3
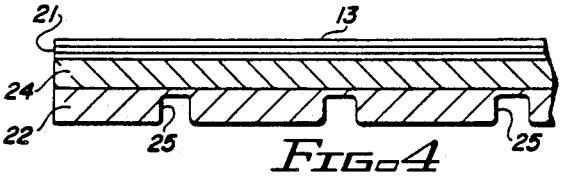
FIG. 4

ACOUSTICAL DOOR

TECHNICAL FIELD

This invention is concerned with enhancing the sound insulating properties of doors and other acoustical panels.

BACKGROUND ART

The sound insulating properties of a wall, or door are reflected in the difference between the incident sound intensity level imposed on one face of the door and the transmitted sound intensity level emanating from the opposite face. The difference is called the "transmission loss". This loss is measured in decibels on a logarithmic scale with higher numbers indicating that the structure is better capable of insulating a space from outside noise.

One factor contributing to high transmission loss for a structure is the shear mass of the structure. The higher the mass, the greater the transmission loss. It is usually possible to build sufficient mass into the walls surrounding a quiet space to prevent the walls from transmitting unwanted noise. Doors to such spaces present special problems because it often is impractical or uneconomical to build sufficient mass into a door to provide the desired sound transmission loss. This is particularly true with respect to standard size doors commonly employed in conventional living and working spaces. Such doors are usually constructed of wood and have a thickness of only $1\frac{3}{4}$ inches.

It is not surprising, then, that some of the techniques of laminating layers of various materials, such as fiberboard, metal and glass wool, employed in producing sound insulating walls and panels have not been adapted successfully to acoustical doors. Examples of such panel constructions are disclosed in U.S. Pat. Nos. 2,116,270, granted May 3, 1938 to J. M. Le Grand for "BUILDING STRUCTURE" and 4,042,061, granted Aug. 16, 1977 to N. Murakami for "CELL-BOX-TYPE NOISE BARRIER HAVING LARGE MAGNITUDE OF TRANSMISSION LOSS AND NOISE INSULATING METHOD".

More recently it has been proposed to utilize a weighted plastic sheet suspended inside a door to help attenuate sound transmission. See U.S. Pat. No. 4,621,709, granted Nov. 11, 1986 to E. N. Naslund for "SOUND ATTENUATING PARTITIONS AND ACOUSTICAL DOORS". The manner in which the weighted plastic sheet is required to be loosely suspended inside the door substantially complicates the construction of a door embodying the invention of this patent.

There continues to be a need for a sound insulating door of conventional size and thickness which is economical to produce and which possesses a high sound transmission loss rating.

DISCLOSURE OF THE INVENTION

This invention stems from the discovery that a high performance acoustical door can be constructed of spaced, multiply panels provided certain plies of the panels have sufficient density and the space between the panels is substantially filled with a fibrous material to reduce sound transmission from one panel to the other. Specifically, each of the door panels comprises three layers joined in face-to-face relationship with a lighter, decorative layer disposed on the outer surface of each panel and backed by two other layers of substantially higher density materials. The two higher density layers may consist of hardboard, or one may be made of hardboard and the other of a weighted plastic sheet.

BRIEF DESCRIPTION OF THE DRAWINGS

The invention is described in greater detail hereinafter by reference to the accompanying drawing wherein:

FIG. 1 is an exploded perspective view of a door constructed in accordance with this invention;

FIG. 2 is an enlarged, horizontal sectional view through a portion of one edge of the door;

FIG. 3 is an enlarged horizontal sectional view through a portion of one edge of a modification of the door; and FIG. 4 is a fragmentary, horizontal sectional view taken as indicated by line 4—4 in FIG. 1.

BEST MODES FOR CARRYING OUT THE INVENTION

Referring particularly to FIG. 1, the door embodying this invention comprises a frame 11, preferably made of wood, which separates and joins at their edge regions first and second panels, designated 12 and 13, respectively.

Frame 11 is comprised of upright edge stiles 14 and top and bottom rails !5 and 16. The outer to inner edge dimensions of the stiles 14 and the rails 15 and 16 are preferably held to a minimum commensurate with providing the door with the required strength against bending and warping. The narrower the stiles 14 and the rails 15 and 16 the smaller the structure borne flanking path for vibration transmission. A large flanking path has the detrimental effect of transmitting sound-induced vibration from one panel directly to the other panel. It has been determined that in the construction of a 3 foot×7 foot door, stiles measuring 1.04 inches by $1\frac{5}{8}$ inches by $84\frac{1}{2}$ inches and upper and lower rails measuring 1.04 inches by $3\frac{3}{8}$ inches by $33\frac{1}{8}$ inches made from alder wood are adequate and provide minimal sound transmission.

Most doors are provided with a lock block 17 disposed within frame 11 adjacent one of the stiles 14. With minimum frame bulk it may be desirable to reinforce the frame 11 in the region of lock block 17 with an intermediate rail 18.

Frame 11 provides an air space 19 between the two door panels 12 and 13. In order to reduce the transmission of sound through the acoustic path in the air space 19, it is desirable for the space to be substantially completely filled with a fibrous sound-absorbing material 20. Examples of such material include a ceramic fiber blanket material sold by Babcock and Wilcox under the trademark "Kao Wool" and a resin-impregnated glass fiber blanket sold by Owens-Corning under the designation "703". The latter material has a density of approximately three pounds per cubic foot and a static spring constant of approximately 1.6 inches of deflection for each pound per square inch of pressure. In a two-panel structure such as this one where the transmission loss rating is limited by losses at lower frequencies corresponding to a resonant condition between the two panels, possibly the most important characteristic of the sound-absorbing material 20 is its porosity. As measured by flow resistance the glass fiber "703" blanket porosity is 60 cgs rayls/inch. It is believed that materials having a porosity in the range of about 40 to 80 rayls/inch will provide optimum performance at the double wall resonant frequencies. Less than optimal performance at the double wall resonance may be acceptable if the transmission loss rating is limited by performance at other frequencies. In this case, a wider range of flow resistance (20–600 rayls/inch) should be considered.

Another important feature of this invention is the construction of the door panels 12 and 13. Each of these panels is of multi-layered construction preferably having a minimum of three layers. See FIGS. 2 and 3 showing two enlarged versions of a corner region of panel 13. Panel 12 is a mirror image of panel 13. The outer layer, designated 21, of each panel 12 and 13 is preferably made of a plywood veneer of approximately 150 inch thickness and having a density of approximately 0.3 pounds per square foot. The outer layer of the plywood veneer 21 is preferably formed of an attractive wood, such as birch, so that layer 21 serves both a decorative and structural function for the door. The plywood veneer layer 21 is quite strong in tension and is capable of resisting warping of the door panels.

The other two layers of each door panel 12 and 13 are of substantially greater density than the plywood veneer layer 21. These two dense layers are designated 22 and 23 in FIG. 2. Layer 22 facing the inside of the door is preferably made from $\frac{1}{8}$ inch hardboard having a density of approximately 64 pounds per cubic foot, which gives a layer density of 0.67 pounds per square foot.

In the embodiment of the invention illustrated in FIG. 2, the middle, or intermediate layer 23 of the panels 12 and 13 is formed of a $\frac{1}{8}$inch thick sheet of weighted plastic material. Preferably, this material is a barium sulfate impregnated vinyl sheet having a density of approximately 1.6 pounds per square foot.

In the embodiment of the invention illustrated in FIG. 3, the middle, or intermediate layer 24 of the panels 12 and 13 is formed of a $\frac{1}{8}$ inch thick sheet of hardboard, like layer 22.

In both embodiments of FIGS. 2 and 3, the three layers forming panels 12 and 13 are joined over their entire faces by means of a suitable glue. Each panel 12 and 13 is, in turn, joined by glue to the faces of frame 11.

It has been observed that the structural components of an acoustical panel, or door, exhibit different transmission loss characteristics for different frequencies of sound. At certain critical frequencies the components exhibit significant drops, or dips, in transmission loss effectiveness. In a two-panel structure such as the door with panels 12 and 13, if the critical frequencies for the two panels coincide they can reinforce each other and further reduce transmission loss at that critical frequency. For this reason it is preferable for the two panels 12 and 13 to be constructed to possess different critical frequencies. And this can be accomplished by providing grooves 25 in the inner face of one of the panels 12 and 13. As shown in FIGS. 1 and 4, these grooves are vertically disposed in the inner layer 22 of panel 13.

Acoustical doors to be truly effective must be sealed within their door frames to preclude sound waves from going over, around and under the door. Usually required, but not forming a part of this invention, is a drop seal mechanism at the bottom edge of the door which forms a seal across the bottom when the door is closed. To accommodate installation of such a drop seal, the inner two layers 22 and 23 or 24 of each panel 12 and 13 can be terminated a short distance above the bottom edge of the door and replaced with wood strip 26 (see FIG. 1). The strips 26 and lower rail 16 can be hollowed out and still provide purchase for fasteners used to hold the drop seal mechanism (not shown) in place.

It should be appreciated that this invention provides an improved acoustical door of simple and inexpensive construction which can be assembled with equipment and methods employed to assemble conventional hollow core doors. There is nothing unusual about the fabrication of the frame 11. And the gluing techniques, materials and equipment to join the three layers of each panel 12 and 13 and to, in turn, join the panels to the frame 11 are known and available. And very little hand labor is required in assembly of the door. No more, in fact, than is required in the assembly of common non-acoustical doors.

And yet, for all their simplicity, doors constructed in accordance with this invention have been demonstrated to exhibit transmission losses of a greater magnitude than was heretofore possible with doors of equal thickness and weight. Fully operable $1\frac{3}{4}$ inch thick doors of the construction shown in FIG. 3, with two hardboard layers 22 and 23 in each panel 12 and 13 have demonstrated a Sound Transmission Class rating of 36. A similar door with the construction shown in FIG. 2 with the intermediate weighted plastic layer 23, demonstrated a Sound Transmission Class rating of 43. Such ratings are ascertained by ASTM Rating Procedure E90-83.

No comprehensive theory of operation has been formulated to explain the performance of doors constructed in accordance with this invention. The performance is believed to be due to combination of factors including: (i) the mass and stiffness imparted to the door panels by the more dense layers therein which reduces the excitability of the panels; (ii) minimal frame structure with the dense layers of the panels overlying most of the frame which reduces the flanking path transmission of vibration from one panel to the other panel; and (iii) the presence of the fibrous sound-absorbing material in the door space which reduces sound transmission via an acoustical path and possibly dampens vibration of the door panels.

What is claimed is:

1. An acoustical door comprising first and second panels having inner and outer surfaces, a frame position between and connecting edge regions of the inner surfaces of said first and second panels to provide and enclose a space between the said panels, each of said panels comprising at least three layers of material bonded in close face-to-face relationship and in which a first layer disposed at the outer surface of each panel is less dense than the second and third layers of each panel and the space between the two panels is substantially completely filled with a fibrous sound-absorbing material.

2. The acoustical door of claim 1 further characterized in that the second layer of each panel is substantially more dense than the third layer of each panel.

3. The acoustical door of claim 2 further characterized in that said second layer in each panel consists of a weighted plastic sheet.

4. The acoustical door of claim 3 further characterized in that said second layer in each panel consists of a barium sulfate impregnated vinyl plastic sheet.

5. The acoustical door of claim 1 further characterized in that said fibrous sound-absorbing material is a resin-impregnated fiberglass material.

6. The acoustical door of claim 1 further characterized in that one of said panels has a plurality of grooves cut in the inner surface thereof.

7. The acoustical door of claim 1 further characterized in that said fibrous sound absorbing material has a porosity of from about 40 to about 80 rails/inch.

* * * * *